US005357914A

United States Patent [19]

Huff

[11] Patent Number: 5,357,914

[45] Date of Patent: Oct. 25, 1994

[54] VENTED VALVE MECHANISM FOR INTERNAL COMBUSTION ENGINES

[75] Inventor: Reggie D. Huff, Tigard, Oreg.

[73] Assignee: ACRO-Techn Inc., Portland, Oreg.

[21] Appl. No.: 110,968

[22] Filed: Aug. 24, 1993

[51] Int. Cl.[5] ..... F01L 1/28

[52] U.S. Cl. ..... 123/79 C; 123/188.2

[58] Field of Search ..... 123/79 C, 188.3, 188.2, 123/188.9

[56] References Cited

U.S. PATENT DOCUMENTS

| | | | |
|---|---|---|---|
| 1,312,730 | 8/1919 | Horn . | |
| 1,569,455 | 1/1926 | Burwell . | |
| 4,901,683 | 2/1990 | Huff | 123/79 C |
| 5,005,538 | 4/1991 | Bergeron | 123/79 R |
| 5,062,397 | 11/1991 | Larson | 277/33 |
| 5,168,843 | 12/1992 | Franks | 123/188.3 |

*Primary Examiner*—Noah P. Kamen

[57] ABSTRACT

A two piece intake or exhaust valve for internal combustion engines comprising an inner and an outer valve which can be designed with orbicular heads. The inner valve including a stem of a smaller outside diameter than the outer valve. The outer valve including a hollow stem large enough to accept the inner valve, and also including a valve seat in the center of its bottom face to seat the inner valve. The head, or base, being equipped with one or more vents which communicate between the intake port and the combustion chamber and being releasably opened and sealed off by the inner valve. The vented valve unit incorporating an independent actuation means by way of pressure differentials created by the induction cycle, and/or directional inertia factors of the mechanically controlled valve element.

14 Claims, 5 Drawing Sheets

VENTED VALVE MECHANISM FOR INTERNAL COMBUSTION ENGINES

BACKGROUND

The invention here disclosed relates to a reciprocating intake or exhaust valve mechanism, and primarily relates to an intake valve for controlling the movement of air/fuel mixture into the combustion chamber of internal combustion engines.

In typical internal combustion engines the valves that control the flow of atmosphere to and from the combustion chamber are one piece, with one spring retainer, and various spring control arrangements.

Since the efficiency of this valve arrangement is a major factor in the performance of the entire engine, many attempts at maximizing the potential flow dimension of these valves have been explored. Since a homogeneous air/fuel mixture is also an important factor in the performance of internal combustion engines, many attempts to use the one piece valve arrangement in different ways to create a swirl effect have also been explored. Increasing the flow dimension allowed by the valve automatically increases the power of the engine. Creating a more homogeneous air/fuel mixture also automatically increases the power of the engine by breaking down the fuel into smaller particles that can be more easily burned, which, more importantly, increases the fuel efficiency and reduces the environmentally harmful emissions of internal combustion engines.

It is toward these fundamental factors of inproved flow dimension (volume) and homogeneous air/fuel charge that the here disclosed invention takes a giant step forward, by accomplishing both at the same time.

It further is the intent of the disclosed invention to address other factors concerning early vented valve designs. Vented valve designs, such as the type disclosed in U.S. Pat. No. 4,901,683, to Huff, integrate two valve elements in a manner to accommodate full mechanical control by one conventional cam lobe. This requires that the cam lift available be shared between the inner and outer valve elements, which reduces the effectiveness of the concept. It further imposes a lash liability which requires a dampening stop means and can reduce longevity. It further requires an extra valve spring retainer system and oil seal for the inner valve. It further complicates manufacture by requiring a through hollow stem for the outer valve. It further complicates retrofit into existing head designs by requiring modification to seals, valve guides, spring seats, and rocker arms, etc.

It is to these fundamental factors effecting the performance, longevity, manufacturability, retrofitability, and cost of vented valves, that the here disclosed invention takes another giant step forward, by accomplishing vast improvements in all areas of concern at the same time, while providing the exceptional bonus of self regulated variable lift and timing to the induction process. Further clarification of the advantages and features of the present invention is provided within the specification.

BRIEF SUMMARY OF INVENTION

This invention relates primarily to engine valving, and, in particular, the reciprocating valves necessary for either the intake of air/fuel mixture into, or the expelling of exhaust gases out of, the combustion chambers of conventional internal combustion engines, wherein the intake and exhaust valve heads incorporate vents in order to vastly improve the flow dimension allowed during the time constrained operation of the intake and exhaust valves.

In order to obtain the maximum power output and efficiency of conventional internal combustion engines it is necessary to maximize the flow dimension of the air/fuel mixture and exhaust gases to and from the combustion chamber. The traditionally accepted method used to attempt this is by use of single stage (function) reciprocating intake and exhaust valves, actuated by a cam transferring a predetermined displacement sequence motion to a rocker arm that transfers its motion to the top of the valve stem, controlling the valve's displacement and timing.

The invention disclosed herein is an intake or exhaust valve for internal combustion engines that automatically takes in and expels atmosphere in two stages and creates a multilayered flow path, instead of a conventional single layer flow path, to allow more atmosphere in and out of the combustion chamber, and, in addition, allow for a broader timing range of flow events, thereby maximizing engine performance at all engine speeds.

In the preferred embodiment the intake vented valve is designed with an inner valve and an outer (main) valve. The outer valve is designed to accept a diminutive inner valve, which is guided by a hollow portion machined linearly into, but not through, the outer valve stem. The outer valve has vertical slots machined through its stem that accept pins inserted perpendicularly through the outer valve slots to allow vertical motion. The outer valve has recessed areas machined to the outside diameter of its stem that act as spring landings for springs that act upon the aforementioned pins to control and dampen the inner valve's vertical motion. The outer valve has vents machined into its head that are releasably sealed off by the head of the inner valve.

The outer valve's actuation and control is dependent upon the direct mechanical application of cam displacement, or hydraulic, pneumatic, or electromagnetic forces. The inner valve's actuation and control is independent of the direct mechanical control of the outer valve. Its diminutive size and weight require light spring control forces, which can be overcome by pressure differentials between the intake port and the combustion chamber (cylinder) created during the induction cycle, and also allow the inner valve to remain open as the inertia of the outer valve is reversed in the direction of the closed position. This allows for controlled, instantaneous actuation, sustained opening of the inner valve during the induction cycle, and instantaneous closing during the compression cycle.

The independent control of the inner valve allows the engine to time its actuation with flow demand and its timing, which varies throughout the R.P.M. range. This increases the torque over a broader R.P.M. range. The multilayered flow path created when both inner and outer valves are open, allowing flow through the vents and around the main seat area of the outer (main) valve, increases flow dimension, which enhances performance. Turbulence past the valve in the combustion chamber is also increased, which reciprocates enhanced fuel efficiency and lowers environmentally harmful emissions.

In the preferred embodiment the exhaust vented valve is designed in a similar manner to the aforementioned intake vented valve. The distinct exceptions include a heavier inner valve and heavier spring control means to withstand the pressure differentials created during the induction cycle to keep the inner valve closed. The inner valve is actuated at the point when the inertia of the outer valve is reversed to the direction of the closed position, and the inertia of the inner valve continues in the direction of the open position and is strong enough to overcome the spring control forces, causing the two valve elements to separate and the inner valve to lag behind as the outer valve closes, allowing flow through the vents and around the outer (main) valve at the same time. The result is improved scavenging of exhaust gases which enhances performance.

DETAILED DESCRIPTION OF PREFERRED EMBODIMENTS

As illustrated by FIGS. 1, 2, 3, & 4, the valve mechanisms, #11A & B and #20A & B are placed into their respective valve guides, #1A & B, and the valve guides are part of the overall head of the engine, #5. For purposes of easy distinction and cross reference all "A" series part numbers indicate intake valve parts, which correspond directly with exhaust valve parts, which are identified as "B" series. The valve mechanisms control the flow of atmosphere through the ports, #4&7, to and from the combustion chamber, #3, by opening and closing at times corresponding with various engine cycles. The piston, #6, moves up and down in its cylinder, #8, in a varied timed sequence with the valve mechanisms to push or pull atmosphere to or from the ports, #4&7, depending on whether it is on an intake or exhaust cycle.

As further illustrated by FIGS. 1, 2, 3, & 4, the valves are formed of two main members, each a distinct and different valve, but both required to make up the composite valve assembly. For purposes of easy distinction the central member, FIG. 1-#11A & B, will be referred to as the inner valve, and the main member, FIG. 1-#20A & B, will be referred to as the outer valve.

Figure 1:
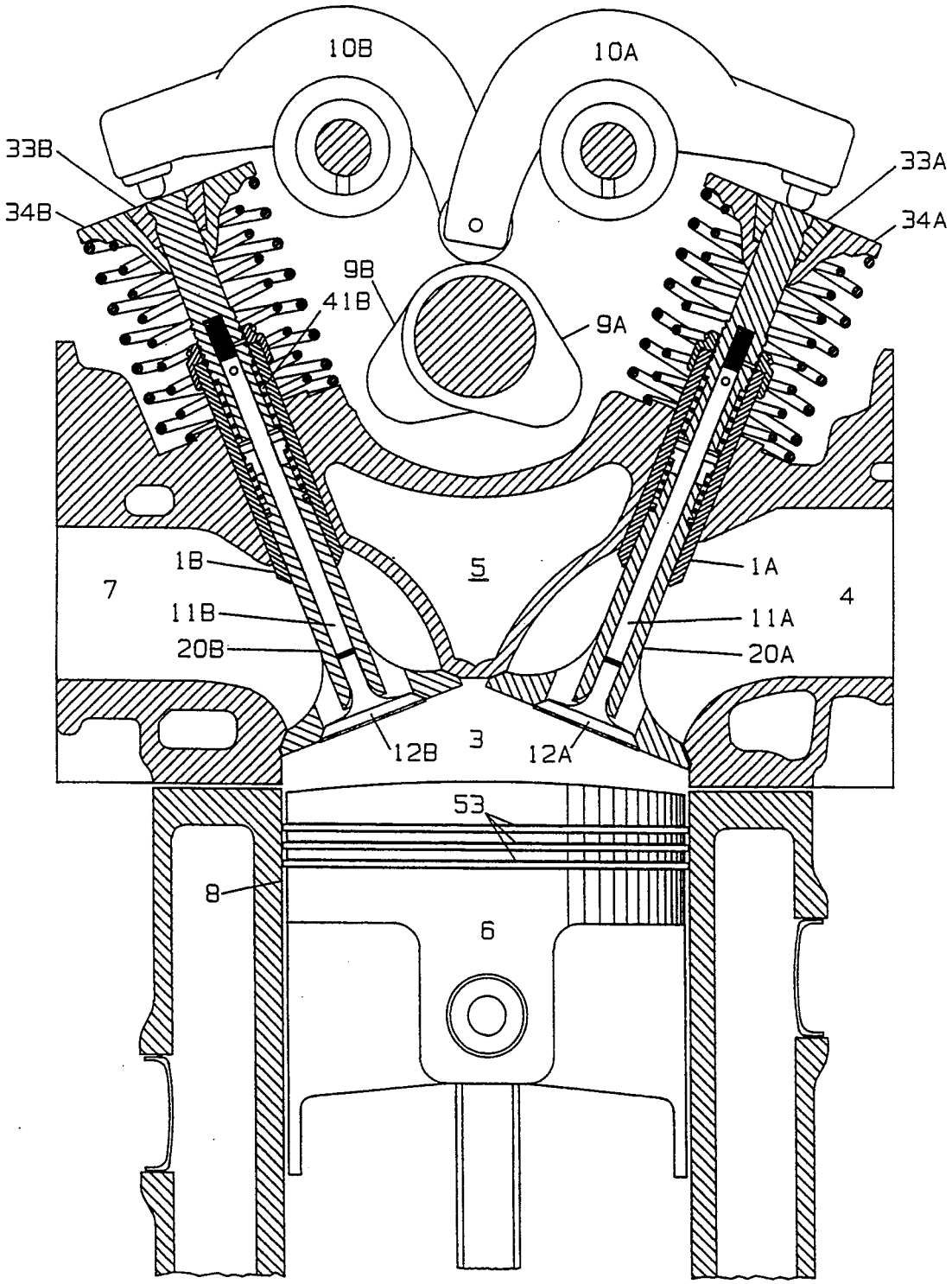
FIG. 1 is a sectional front view of a typical internal combustion engine comprising the vented valve assemblies, illustrating the inner workings and design of the vented chamber and the springs, pins and other various components, in the resting position.
Figure 4:
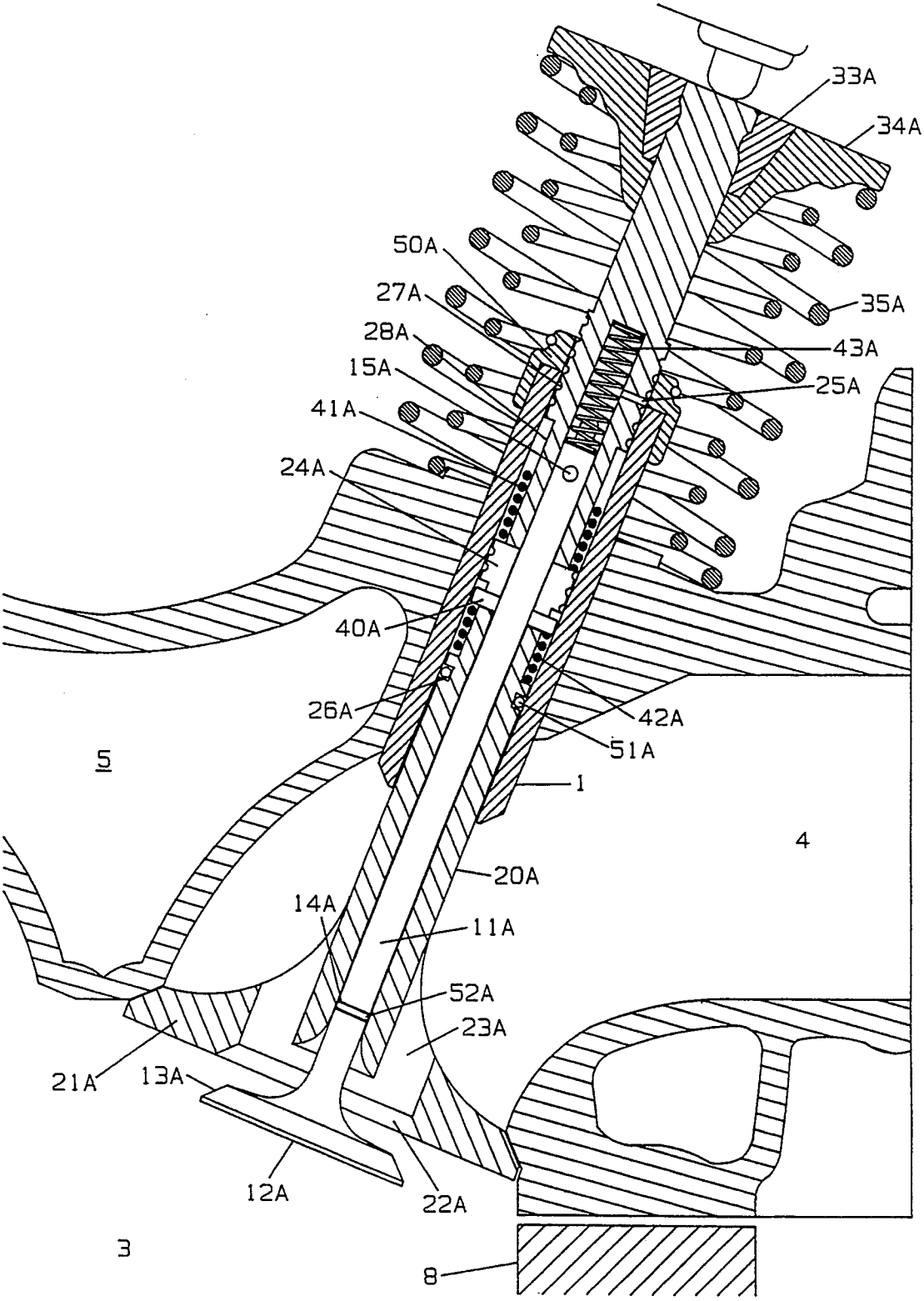
FIG. 4 is an expanded view of an intake or exhaust vented valve assembly alone.
Figure 6:
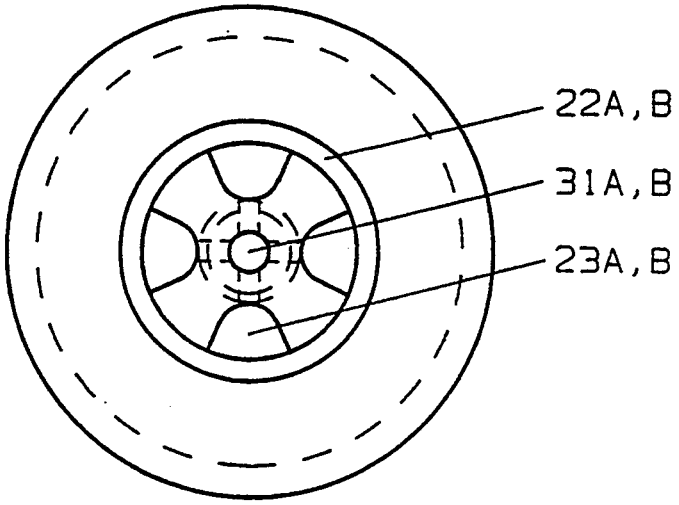
FIG. 6 is an expanded bottom view of an intake or exhaust outer valve without the inner valve, to illustrate where the inner valve is placed and the inner passage ways of the outer valve.

As illustrated by FIG. 4, 5, & 6, the inner valve, FIG. 4-#11A, is constructed with a base, FIG. 4-#12A, which could incorporate many different traditional internal combustion engine valve designs as to the shape of the base. The base of the inner valve, FIG. 4-#12A, is formed with an angle(s) cut throughout the circumference of its side portion, FIG. 4-#13A. This angle(s) corresponds with the angle(s) cut into the circumference of the annular seat in the base of the outer valve, FIGS. 4 & 6-#22A & B, so as to form a complete seal when mated in the closed position, as depicted in FIG. 1. The inner valve has a stem, FIG. 4-#11A, attached to its base, FIG. 4-#12A, that is inserted through a hole, FIG. 6-#31A & B, that, in the preferred embodiment, runs into, but not through, the outer valve stem, FIGS. 1 & 4-#20A & B.

Figure 2:
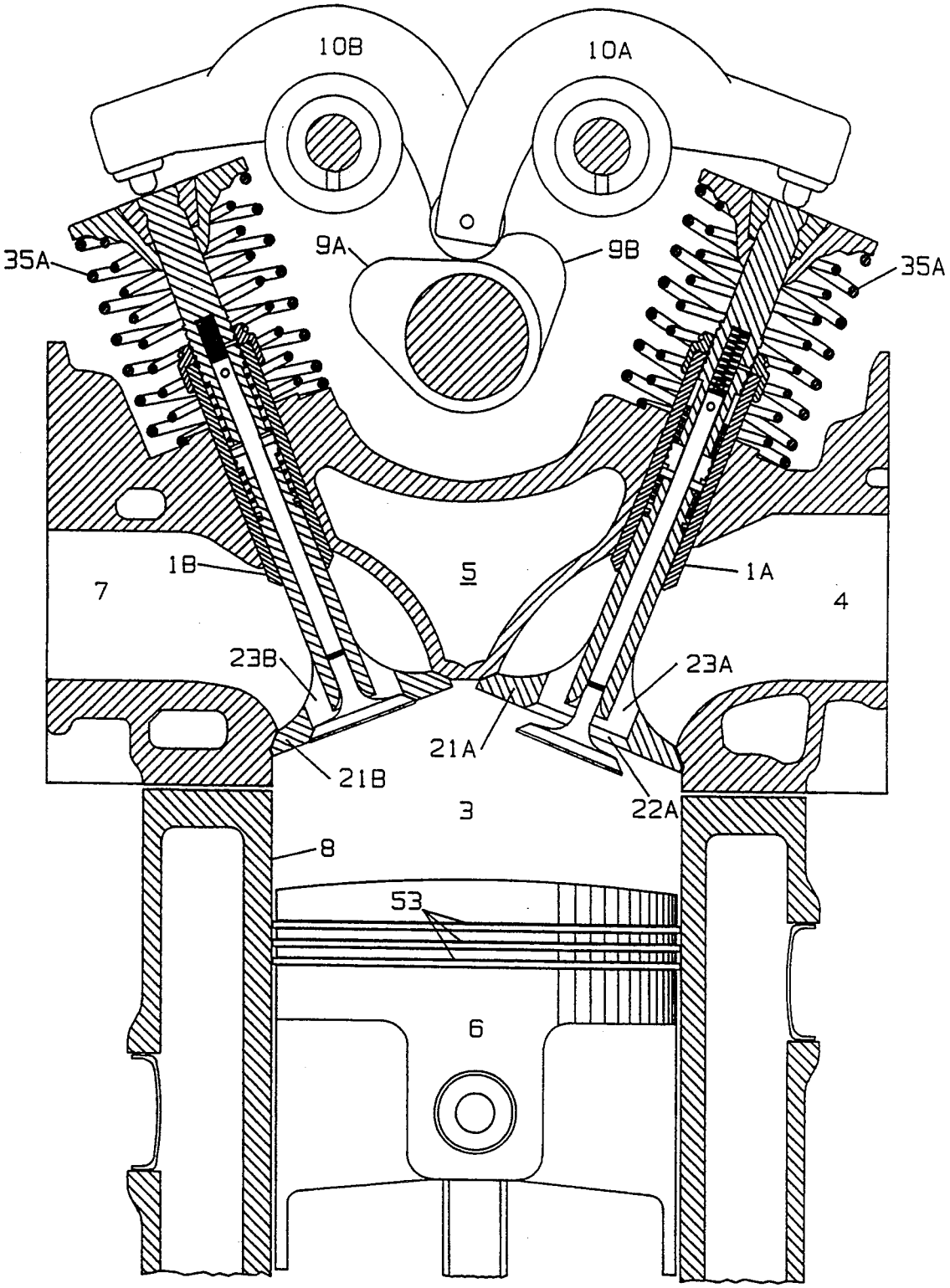
FIG. 2 is a sectional front view of a typical internal combustion engine during the induction cycle comprising the intake vented valve assemblies with the inner valve in the fully open position, and the outer valve in a resting or fully closed position.
Figure 3:
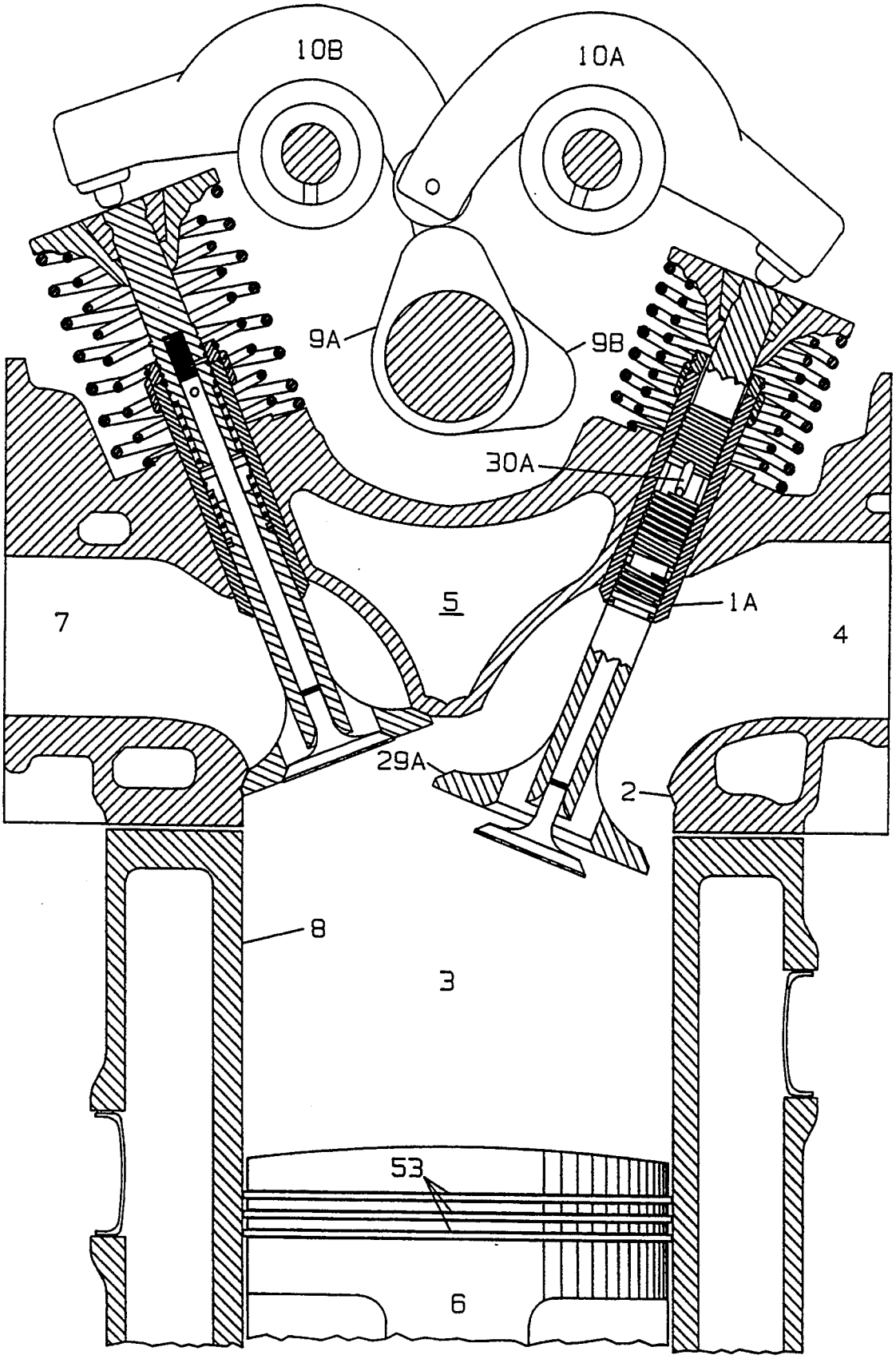
FIG. 3 is a sectional front view of a typical internal combustion engine during the induction cycle, illustrating the intake vented valve assembly with the inner and outer valves in the fully open position, and a nonsectional portion of the stem.
Figure 5:
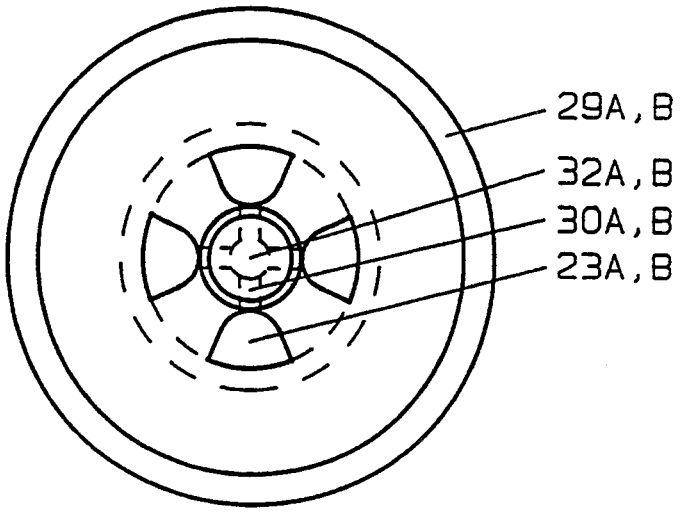
FIG. 5 is an expanded plan view of an intake or exhaust outer valve without springs or an inner valve, to illustrate one of the many possible designs of the vents in the outer valve.

As illustrated by FIGS. 2, 3, & 5, the outer valve is constructed with a base, FIG. 2 #21A & B, that could incorporate many different designs as to the shape of the base, and has an angle(s) cut throughout the circumference of the outside edge of the base, FIGS. 3 & 5-#29A & B, that corresponds with the angle(s) cut into the circumference of the annular seat area formed at the port edge, FIG. 3 #2.

As illustrated by FIGS. 4, 5, & 6, the outer valve is constructed with a vent(s), FIGS. 4, 5, & 6 #23A & B, on the top, or port side, of the base of the outer valve. This vent(s) allows communication between the port, FIG. 4-#4, and the combustion chamber, FIG. 4-#3.

As illustrated by FIGS. 3 & 4, the outer valve, FIG. 4-#20A, has machined grooves formed at the top of the stem, FIG. 4-#36A, to accept spring retainer locks, FIG. 4-#33A, which lock an annular spring retainer, FIG. 4-#34A, at the top of the stem. This is in order to retain the coil spring, FIG. 4-#35A, in a predetermined preload position and maintain constant pressure against the outer valve in the direction of the closed position until a cam lobe, FIG. 3-#9A, transfers its displacement to a rocker arm, FIG. 3-#10A, to displace the outer valve in the direction of the open position, as depicted in FIG. 3.

As illustrated by FIGS. 3 & 4, the outer valve stem, FIG. 4-#20A, includes a recessed area(s), FIG. 4-#28A, that is contained within the valve guide, FIG. 4-#1A, and acts as a spring landing(s) for the inner valve control spring(s), FIG. 4-#41A & 42A. Access of the spring(s) to the spring landing(s) is facilitated by a machined helical groove, FIGS. 3 & 4-#27A.

The inner valve stem, FIG. 4-#11A, includes a pin access hole(s), FIG. 4-#15A, which allows access of a retainer pin(s), FIGS. 3 & 4-#40A. The pin(s) is contained within a slot(s) machined into the outer valve stem, FIG. 3-#30A. The inner valve control spring(s), in a predetermined preload position, acts upon the inner valve retainer pin(s) with constant pressure in the direction of the closed position until the inner valve is displaced open. Contained within the hollowed portion of the outer valve stem, directly above the inner valve stem, is a compression spring, FIG. 4-#43A, which exerts a predetermined preload pressure against the inner valve stem in the direction of the open position to dampen the mating of the inner valve to its seat in the outer valve base. The outer valve stem includes a pressure relief hole, FIG. 4 #25A, that runs directly into the cavity within the hollowed outer valve stem directly above the inner valve stem.

As illustrated by FIG. 4, lubricity control is facilitated by a series of annular oil seals including the main or primary seal, #50A, and two secondary seals, #51A & 52A, that are contained within a groove formed in the outer valve stem, #26A, and a groove formed in the inner valve stem, #14A.

DETAILED OPERATION OF PREFERRED EMBODIMENTS

As illustrated in FIG. 1, when both the intake and exhaust valve mechanisms are in a resting and fully closed position the intake port, #4, and the exhaust port, #7, are blocked from communication with the combustion chamber, #3, and a complete seal from combustion pressures created by the combustion process is facilitated.

As illustrated by FIG. 4, the inner valve, #11A, is diminutive and light, and, in the preferred embodiment, is made of titanium to keep weight to a minimum. This, in turn, allows the control spring(s), #41A & 42A, to be small enough to be confined within the recessed area(s) of the outer valve, #28A, and the valve guide, #1A.

As depicted in FIGS. 2, 3, & 4, after exhaust gases have been scavenged from the combustion chamber and the induction process begins the piston, FIG. 2-#6, begins to move rapidly down the cylinder, FIG. 2-#8, and is sealed against the cylinder by means of multiple rings, FIG. 2-#53. This creates a rapid pressure drop in the combustion chamber, FIG. 2-#3, which at a certain point becomes lower than the pressure in the intake port, FIG. 2-#4. This pressure differential applies force against the port side of the intake valve mechanism. When this force is applied against the head of the inner valve and becomes greater than the force applied against the retainer pin(s), FIG. 3-#40A, by the inner valve control spring(s), FIG. 4-#41A & 42A, the inner valve is displaced open independent of the outer valve allowing the flow of air/fuel mixture from the port through the outer valve vent(s), FIG. 2, 4, 5 & 6-#23A & B, into the combustion chamber. The actuation speed, duration and displacement are determined by the load rate(s) of the inner valve control spring(s), while the retainer pin slot(s), FIG. 3-#30A & FIG. 4-#24A, determines the maximum displacement range of the inner valve.

The outer valve remains static until a cam lobe, FIG. 2-#9A, transfers its displacement to a rocker arm, FIG. 3-#10A, to displace the outer valve in the direction of the open position in a predetermined timed sequence, as depicted in FIG. 3.

The aforementioned pressure differential, which is responsible for the inner valve's initial actuation and displacement, changes its timing in relation to the crank angle throughout the R.P.M. (revolutions per minute) range. It also changes in response to throttle position. Since the inner valve actuation is independent of the outer valve actuation it automatically responds to these changes with varied timing, duration and displacement. This significantly broadens the torque and power useful output range as well as improves the throttle response of a typical internal combustion engine.

As depicted in FIG. 3, when both inner and outer valves are displaced open at the same time open valve area is increased, which in turn improves flow dimension, increases velocity of the air/fuel atmosphere, and increases turbulence in the combustion chamber, which creates a more homogeneous air/fuel charge. This significantly improves the performance, fuel efficiency, and emission quality of a typical internal combustion engine.

As illustrated in FIGS. 1 & 2, the exhaust valve mechanism is designed with an outer valve, FIG. 1 #20B, and an inner valve FIG. 1-#11B. In the preferred embodiment the inner valve is made of stainless steel rather than titanium in order to increase the weight.

The inner valve control spring(s), FIG. 1-#41B & 42B, is designed with a much higher preload and load rate than the intake inner valve control spring(s) in order to retard any tendency toward displacement in the direction of the open position in reaction to pressure differentials created during the induction cycle.

As the exhaust cycle begins a cam lobe, FIG. 2-#9B, tranfers its displacement to a rocker arm, FIG. 2-#10B, to displace the outer and inner valve in the direction of the open position in a predetermined timed sequence. At the high R.P.M. range the exhaust valve mechanism is displaced open very rapidly creating increased inertia in the direction of the open position. When the cam lobe reaches its maximum displacement the larger outer valve control spring(s), FIG. 2-#35B, reverses the direction of the outer valve in the direction of the closed position. The inertia built up in the inner valve forces it to continue in the direction of the open position. At this point both inner and outer valves are open allowing the vent(s), FIG. 2-#23B, communication between the combustion chamber, FIG. 2-#3, and the exhaust port, FIG. 2-#7. This increases the open valve area, which enhances the scavenging of exhaust gases from the combustion chamber to the exhaust port, improving performance.

I claim

1. A poppet valve comprising:

a) an outer valve means configured with a hollow stem and means defining at least one vent opening through the base of the outer valve means for communicating a passage between a cylinder and its respective ports;

b) an inner valve means associated with the outer valve means to selectively open and close the vent opening through the outer valve base, the inner valve configured with a valve stem carried within the hollow stem of the outer valve means and an inner valve base means arranged to releasably seal the vent opening through the base of the outer valve means;

c) an outer valve stem spring landing means to retain an inner valve control spring around the outer valve stem in a predetermined linear position at a predetermined preload length; and d) an outer valve stem spring landing access means to install the inner valve control spring onto and within the spring landing means.

2. The valve mechanism as claimed in claim 1 including inner valve return damping means engaging the inner valve means to dampen the mating of the inner and outer valve means.

3. A poppet valve comprising:

(a) an outer valve means configured with a hollow stem and means defining at least one vent opening through the base of the outer valve means for communicating a passage between a cylinder and its respective ports, b) an inner valve means associated with the outer valve means to selectively open and close the vent opening through the outer valve base, the inner valve configured with a valve stem carried within the hollow stem of the outer valve means and an inner valve base means arranged to releasably seal the vent opening through the base of the outer valve means; and c) retention means engaging the outer valve stem and the inner valve stem to retain the inner valve means against disengagement from outer valve means and to define the displacement range of the inner valve means.

4. The valve mechanism as claimed in claim 3, wherein the outer valve stem includes a helical groove formed on its outer surface.

5. The valve mechanism as claimed in claim 3, wherein the outer valve stem includes an annular oil seal.

6. The valve mechanism as claimed in claim 3, wherein the inner valve stem includes an annular oil seal.

7. The valve mechanism as claimed in claim 3, wherein the outer valve stem includes a pressure relief hole communicating between the hollow stem inner area and the stem outer surface.

8. A poppet valve comprising:

a) an outer valve means configured with a hollow stem and means defining at least one vent opening through the base of the outer valve means for communicating a passage between a cylinder and its respective ports;

b) an inner valve means associated with the outer valve means to selectively open and close the vent opening through the outer valve base, the inner valve configured with a valve stem carried within the hollow stem of the outer valve means and an inner valve base means arranged to releasably seal the vent opening through the base of the outer valve means;

c) an outer valve control means for selectively controlling the operation of the said outer valve means in a predetermined timed sequence; and d) an inner valve control means defined as independent from the outer valve control means to effectively control the actuation range and the actuation as a direct response to pressure differentials between the cylinder and port created during normal engine cycles in an unpredetermined timed sequence.

9. The valve mechanism as claimed in claim 8 including inner valve return damping means engaging the inner valve means to dampen the mating of the inner and outer valve means.

10. The valve mechanism as claimed in claim 8, wherein the inner valve is formed of a titanium alloy material.

11. The valve mechanism as claimed in claim 8, wherein the inner valve stem includes an annular oil seal.

12. The valve mechanism as claimed in claim 8, wherein the outer valve stem includes an annular oil seal.

13. The valve mechanism as claimed in claim 8, wherein the outer valve stem includes a helical groove formed units outer surface.

14. The valve mechanism as claimed in claim 8, wherein the outer valve stem includes a pressure relief hole communicating between the hollow stem inner area and the stem outer surface.

* * * * *